United States Patent [19]

Sakaki

[11] Patent Number: 4,912,908

[45] Date of Patent: Apr. 3, 1990

[54] BAND TIGHTENING APPARATUS IN A STRAPPING MACHINE

[75] Inventor: Yasunori Sakaki, Tokyo, Japan

[73] Assignee: Strapack Corporation, Tokyo, Japan

[21] Appl. No.: 196,470

[22] Filed: May 20, 1988

[30] Foreign Application Priority Data

Jun. 4, 1987 [JP] Japan ..... 62-86222[U]

[51] Int. Cl.[4] ..... B65B 13/22; B65B 13/06

[52] U.S. Cl. ..... 53/589; 100/29; 100/32

[58] Field of Search ..... 100/2, 4, 17, 25, 29, 100/32; 53/399, 589, 389

[56] References Cited

U.S. PATENT DOCUMENTS 4,020,756 5/1977 Weiss ..... 100/29 X
4,120,239 10/1978 Pasic et al. ..... 100/32 X
4,383,881 5/1983 Sakaki .
4,635,541 1/1987 Kasuga ..... 100/2
4,724,659 2/1988 Mori et al. ..... 100/29 X

*Primary Examiner*—Horace M. Culver
*Attorney, Agent, or Firm*—Burns, Doane, Swecker & Mathis

[57] ABSTRACT

A strapping machine applies an article around a band. The band is advanced around an arch guide by forward-rotation rollers and is retracted or restored by reverse-rotation rollers. The reverse-rotation rollers comprise a reverse-rotation drive roller and a reverse-rotation touch roller which define a nip in which the band is gripped. The touch roller is displaced downwardly toward the drive roller by a cam which displaces an arm. The arm pulls downwardly upon a coil spring which is operably connected to the touch roller. A manual adjustment is provided which enables the amount of displacement of the touch roller to be easily adjusted. The cam may include projections of different radial dimension to exert different amounts of force on the band as the cam rotates.

13 Claims, 4 Drawing Sheets

BAND TIGHTENING APPARATUS IN A STRAPPING MACHINE

BACKGROUND AND OBJECTS OF THE INVENTION

Field of the Invention and Related Art

The present invention relates to a band-tightening apparatus in a strapping machine.

Various types of band-tightening apparatus in strapping machines have conventionally been proposed. In a structure in which a strapping band is compressed between two rollers and then restored and tightened, some band-tightening apparatus are so constructed that the driving shafts of the rollers are connected to a drive mechanism by means of electromagnetic clutches whereby the voltage of the electromagnetic clutches are adjusted to give a predetermined tightening strength. Also, detection means is provided for detecting when the tightening torque has reached a predetermined value (i.e., roller speed decreases due to slip of the electromagnetic clutches because of the predetermined voltage) whereby the band-tightening strength is adjusted by interruption of energization of the clutches. Such a tightening operation involves a transmission of rotation by means of the drive mechanism due to the magnetic force between the armature plates of the electromagnetic clutches and filed cores. In such a case, the maximum and minimum tightening force is dependent upon the maximum and minimum electromagnetic force necessary for transmission of the turning effort. Although the smaller the gap between the armature plate and the field core, the less electromagnetic force obtainable, the gap cannot be reduced because of rust produced by humidity in the absence of operation thereof for a long period of time. The size of the gap is at present 0.3 to 0.5 mm and the minimum tightening force is about 10 kg in this case. Accordingly, there is a disadvantage in that weak tightening tightened by force smaller than the above such as soft strapping of an envelope and a soft carton is impossible.

In addition, variation in compressive contact force imposed on the band by the driving and touch rollers to adapt the amount of tightening to the kind and size of an article to be strapped is conventionally very troublesome. In U.S. Pat. No. 4,383,881, for instance, an actuating rod is pivotably attached to the front end of the eccentric shaft of a reverse rotation touch roller and the lower end of the actuating rod is loosely attached to an L-shaped interlocking rod by means of a spring. The lower end of the interlocking rod is attached to the end of an arm. One end of the arm is pivotably supported by a shaft projected from a base, and a rotor provided on the arm is brought into contact with a cam attached on a shaft which is an extension of a cam shaft for operating a mechanism for grasping the front end and the feeding end of the band and mechanisms for fusing ad cutting the band. When the cam rotates by means of the rotation of the cam shaft, the acting surface of the cam projection pushes down the rotor or the arm rod, such that a reverse rotation touch roller can be brought into compressive relationship with a drive roller to reverse the band disposed therebetween. However, even if variation in the tension of the spring can alter a touch pressure (compressive contact force) on the drive roller of the reverse rotation touch roller, a double-locking screw which holds the spring between the L-shaped interlocking rod must be turned to adjust the pressure, so that the operation is very complicated.

Even if the touch pressure is reduced by adjusting the same to a level immediately before the roller slips on the surface of the band, the force for stopping the turning effort of heavy, rotatable bodies such as an electromagnetic brake and a pulley is so high that envelopes and soft cartons cannot softly be strapped. Because the strong force applied to the rollers tightens the band, soft strapping is impossible. Even if a friction plate against a pulley plate is provided, instead of the electromagnetic brake, to alter the applied pressure by means of a holding plate through the intermediary of a spring, whereby the touch pressure of the reverse rotation touch roller is reduced as is the case with the electromagnetic brake, the force for stopping the turning effort of heavy, rotatable bodies such as frictional plates, pulleys, and springs is so strong that an envelope and soft cartons cannot be softly strapped (weak tightening is impossible). Accordingly, there is a disadvantage in that weak tightening is impossible even by reducing the compressive contact force on the drive roller of the reverse rotation touch roller by adjusting the spring.

Even if voltage applied to the electromagnetic clutch is adjusted and the spring of the L-shaped interlocking rod is adjusted to be capable of satisfying a demand to softly tighten an article to be strapped, when weak tightening force is established, a force sufficient to remove the band from an arch guide cannot sometimes be applied to the band; this may occur in a so-called full-automatic strapping machine provided with the arch guide constituting a band passage for arranging the band in the form of a loop around the article to be strapped. The fact is more outstanding with an increased size of the arch guide. Accordingly, soft tightening of the band around the article to be strapped by adjustment of the voltage can only be applied to a so-called semi-automatic strapping machine with no arch guide.

In the mechanisms for restoring and tightening the band disclosed in U.S. Pat. No. 4,383,881 as described above, pushing down of the L-shaped interlocking rod and displacement of the reverse rotation touch roller toward the reverse rotation drive roller are performed by one acting surface formed on the cam. Thus, the restoring process for winding the band around the article to be strapped and the tightening process for tightening the band around the article to be strapped are effected by that acting surface. When the double locking screw is turned to increase the tension of the spring whereby the reverse rotation touch roller is strongly brought into compressive contact with the band to strongly tighten the band around the article to be strapped, the band is subjected to strong friction during both the restoration and tightening stages. As a result, a soft band surface may be scraped longitudinally and may be crushed, horizontally zig-zagged on a plane, vertically folded, or cut on the scraped portion.

When such a deformed band is subsequently fed into the band guide arch, the band may become jammed inside of the band guide arch.

SUMMARY OF THE INVENTION

It is an object of the present invention to facilitate the adjustment of the compressive contact force of the band between the reverse rotation touch roller and the reverse rotation roller.

It is an object of the present invention to easily adjust the above-described compressive contact force from the outside of the main body thereof.

It is another object of the present invention to remove the band from a band guide arch accurately and at high speed to wind the band around the article to be strapped even when weak tightening force is established.

It is still another object of the present invention to provide strong tightening force without damaging the band surface by means of restoration and tightening of the band.

In order to achieve the above objects, in the present invention, an eccentric projection is formed at the front end of the eccentric shaft of the reverse rotation touch roller. A shaft case interconnects that eccentric shaft to a cam-actuated adjusting arm by means of a spring. A shaft rod is freely pivotable on the projection and is rotatably mounted in the shaft case. The shaft rod is manually rotatable so as to vary the magnitude of force applied to the reverse-rotation touch roller in response to displacement of the arm.

In the present invention, the reverse rotation touch roller is adapted to slip on the band surface upon the completion of tightening of the band around the article to be strapped.

Two acting surfaces of different radii are formed on the tension cam to restore the band on the first acting surface during the setting time of the timer (or for a period when the acting surface continues rotation of the cam) thereby enabling accurate removal of the band from the arch guide ad sufficient tightening of the band around the article to be strapped due to the influence of the second acting surface without cutting or scraping a soft, narrow band.

In the present invention, the arm is connected to the spring through the intermediary of a slot thereby enabling weak tightening of the band by means of the first acting surface of the tension cam without applying unnecessary pressure on the band in restoring the band.

BRIEF DESCRIPTION OF THE DRAWINGS

The objects and advantages of the invention will become apparent from the following detailed description of preferred embodiments thereof in connection with the accompanying drawings in which like numerals designate like elements, and in which.

DETAILED DESCRIPTION OF PREFERRED EMBODIMENTS OF THE INVENTION

Figure 1:
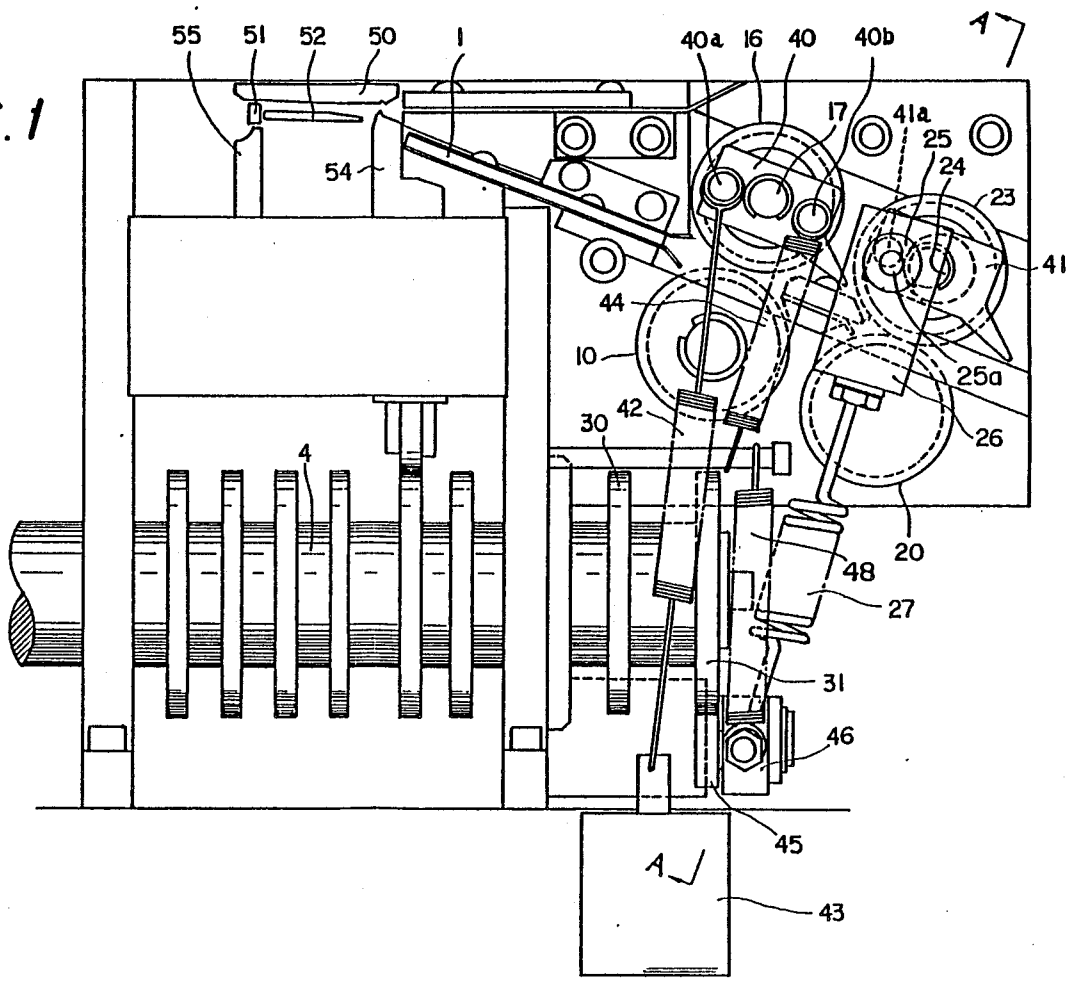
FIG. 1 is a side elevational view of a band feeding-/reversing mechanism of a strapping machine according to the invention.

The embodiment in the present invention is described with reference to FIGS. 1 to 3. A forward rotation roller 10 and a reverse rotation roller 20 are spaced along a band chute 1. The drive shaft 11 of the forward rotation roller 10 is provided with a pulley 13 and is connected to a motor (not shown) by means of a V-belt 14. A gear 15 is disposed in front of the pulley 13 of the drive shaft 11 to engage the gear 15 with a gear 22 provided on the shaft 21 of the reverse rotation roller 20 thereby rotating both of the rollers in a reverse direction to each other. The reverse rotation roller 20 is shaft-supported through the intermediary of a one-way bearing 34 for free rotation in a direction of tightening action alone.

Forward and reverse rotation touch rollers 16 and 23 are shaft supported on eccentric shafts 17 and 24, respectively. Two sets of nip-defining rollers for forward rotation and reverse rotation are constituted by the following pairs: the forward rotation touch roller 16 with the forward rotation roller 10, and the reverse rotation touch roller 23 with the reverse rotation roller 20, respectively.

The nearly center portion of an acting segment 40 is affixed to the front end of the eccentric shaft 17 of the forward rotation touch roller 16. The actuating segment 40 is provided with the pins **40*a* and 40*b* disposed on opposite sides of the eccentric shaft 17 which is placed at the center therebetween. The upper end of a forward rotation spring 42 is pivotably attached to the pin 40*a* and is engageable for pressurizing the forward rotation touch roller 16 toward the forward rotation roller 10, and the lower end of the forward rotation spring 42 is connected to a solenoid 43 which energizes the spring 42. In addition, a spring 44 is attached to the pin 40*b* of the actuating segment 40 thereby constantly biasing the forward touch roller 16 away from the forward rotation roller 10**.

The front end of the eccentric shaft 24 of the reverse rotation touch roller 23 is inserted into a hole which is drilled at the rear end of an actuating segment 41, which is provided with a projected shaft **41*a* which is offset laterally from the eccentric shaft 24. The projected shaft 41*a* is pivotably inserted into an eccentric hole 25*b* provided in a cylindrical shaft rod 24. The shaft rod 25 is pivotably inserted into the hole 26*b* of a shaft case 26. A reverse rotation spring 27 is attached to the lower end of the shaft case 26 and the lower end of the reverse rotation spring 27 is attached to a projection 46*a* of an arm 46 carrying a rotor 45. The upper end of the reverse rotation spring 27 is threadedly engaged with the lower end of the shaft case 26 through the intermediary of a lock nut 26*a***.

One end of the arm 46 is pivotably shaft-supported on a shaft 47 projected from the base 2 and the other end thereof is biased upwardly by a spring 48. The shaft rod 25 is connected to a tightening adjustment dial 63 provided on the outside of the main body of the strapping machine by means of a tightening adjustment shaft or a flexible wire 61 shaft-supported by a shaft receiver 62. The tightening adjustment shaft receiver 62 is secured to the outer plate of the main body in the strapping machine.

Figure 2:
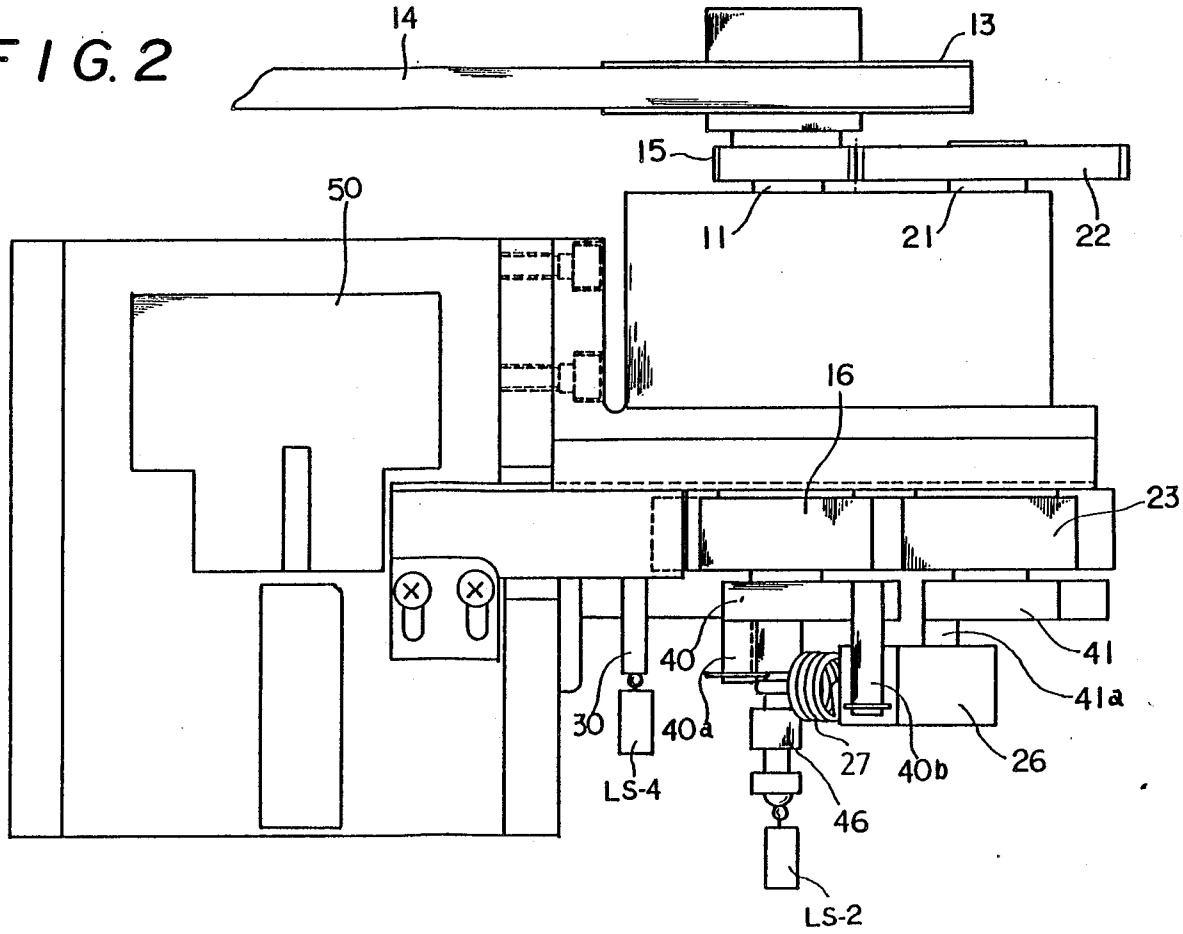
FIG. 2 is a plan view of the mechanism depicted in FIG. 1.
Figure 3:
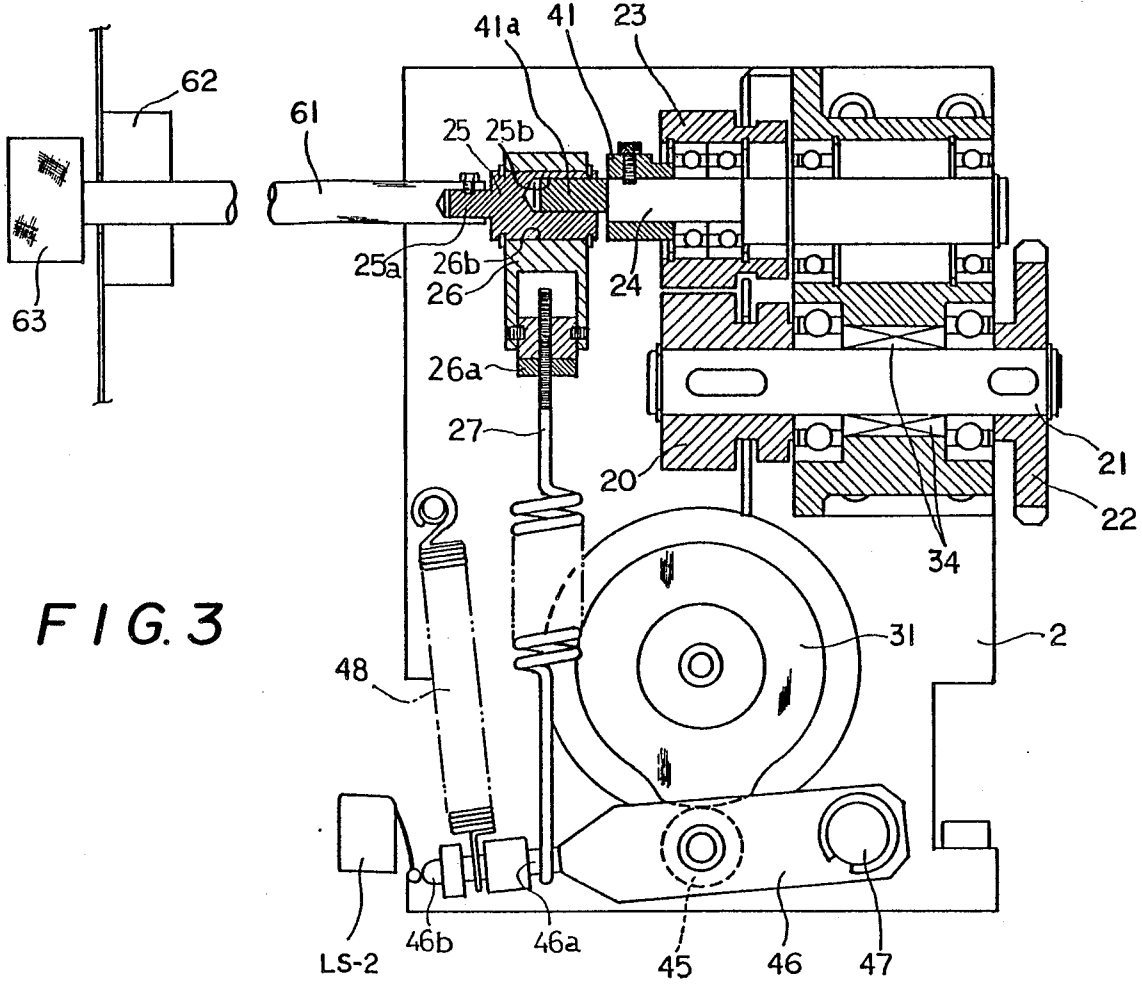
FIG. 3 is a frontal view of a modified configuration of a tension cam.

Referring to FIG. 2, LS-2 is a limit switch provided at the front end **46*b* of the arm rod 46 and LS-4 is a limit switch provided so as to contact a later-described tension cam. Both of the switches are turned 0N by the rotation of a later-described tension cam 31 and a cam 30, respectively, provided on the cam shaft 4** to produce a predetermined signal.

The cam 30 and the tension cam 31 are provided on a shaft which is an extension of the cam shaft 4 for operating known mechanisms 54, 55 for grasping the front end and the end of the band, and a fusion mechanism and a cutting mechanism (not shown). The tension cam 31 is abutted against the rotor 45 of the arm 46 to operate in association with the reverse rotation spring 27 and the actuating segment 41. The cam shaft 4 is rotated and driven by a speed reducer which interlocks with a motor (not shown).

In the drawing, a numeral 50 denotes a slide table, 51 denotes the actuating segment of a limit switch LS-1 (not shown) and 52 denotes a band guide.

The pulley 13 which rotates with a motor (not shown) through the intermediary of a V-belt 14 causes the drive shaft 11 and the forward rotation roller 10 to rotate counterclockwise with respect to FIG. 1. The gear 22 in engagement with the gear 15 causes the reverse rotation roller 20 to rotate clockwise with respect to the drawing.

When the forward rotation touch roller 16 is not energized by the solenoid 43, however, it is energized by the spring 44 so as to release the band. When the convex portion of the tension cam 31 is not pushing down the rotor 45, a space exceeding the thickness of at least one band is formed between the rollers 20, 23, and no effect is exerted on the band in the band chute 1.

When the front end of the band presses the actuating segment 51 of the limit switch LS-1 provided at the end of the band guide 52, the cam shaft 4 rotates to elevate the right pressing portion 54 (a grasping mechanism) thereby grasping the band end. Because the tension cam 31 is also rotating simultaneously, the actuating segment 41 is pulled down through the intermediary of the rotor 45, the arm 46, the reverse rotation spring 27, the shaft case 26, an the shaft rod 25. In this case, the eccentric shaft 24 pivotably rotates in the form of an arc and the reverse rotation touch roller 23 which is shaft-supported by the eccentric shaft 24 is pushed down toward the reverse rotation roller 20. Accordingly, the band is gripped and restored by the reverse rotation rollers 20 and 23 which are rotatably driven. Also, the rotation of the tension cam 31 pushes down the arm 46 to turn ON the limit switch LS-2 provided at the end of the arm 46 to stop the shaft 4 and actuate a counter. After a pre-established time, the cam shaft 4, vi., the tension cam 31 resumes rotation such that the rotor 45 and the arm 46 push up the reverse rotation spring 27 by the energization of the spring 48, whereby the reverse rotation touch roller 23 is raised and separated from the reverse rotation roller 20. The pre-established time can be adjusted according to the size of the article to be strapped.

When the restored band is completely wound around the article to be strapped so that a so-called primary tightening has been completed, a subsequent tightening force is effected because of the sufficient torque of the motor before the touch roller 23 is raised. The compressive contact force of the reverse rotation touch roller 23 on the reverse rotation roller 20 is interlocked by the pushing-down force of the arm 46 by means of the rotation of the tension cam 31 through the intermediary of the reverse rotation spring 27. Because the length of the push-down stroke of the shaft case 26 by the arm 46 is made constant by means of the lock nut **26*a*, the compressive contact force of roller 23 can be adjusted by varying the tension of the reverse rotation spring 27 by other means. In the present invention, this is achieved by rotation of the shaft rod 25 which varies the length between the projected shaft 41*a* of the actuating segment 41 and the lower end of the reverse rotation spring 27. Accordingly, when the arm 46 is pushed down, the tension applied to the reverse rotation spring 27 is altered thereby enabling easy alteration of the magnitude of the compressive force of the reverse rotation touch roller 23 against the reverse rotation roller 20. Because the front end 25*a* of the shaft rod 25 is connected to a tightening adjustment dial 63 provided on the outside of the main body of the strapping machine, the tightening force can be freely adjusted by rotating the tightening adjustment dial 63 from the outside of the main body of the strapping machine. In so doing, the reverse rotation touch roller is not pivotably rotated by the eccentric shaft 24 because the eccentric hole 25*b* of the shaft rod 25 rotates around the pin 41*a* when the tightening adjustment dial 63** is rotated and adjusted.

Afterward, rotation of the cam shaft 4 actuates a fusing device which effects a fusion between band-joining portions by means of a known press member and a heater, and then actuates a cutter which effects a cutting of the band at the band-feeding end situated at the right end of the mechanism 54 for grasping the band front end.

Subsequently, upon rotation of the cam shaft, the cam 30 turns the limit switch LS-4 ON to energize the solenoid 43, whereby the actuating segment 40 is pushed down by means of the forward rotation spring 42 to compress the band between the reverse rotation touch roller 16 and the forward rotation roller 10 thereby feeding the band toward the arch at the outside of the main body of the strapping machine.

The ON signal of the limit switch LS-4 turns another timer ON so that energization into the solenoid 43 after the elapse of the established time and the spring 44 raises the forward rotation touch roller 16 to release the compressive contact with the band, whereby feeding of a predetermined amount of band is completed. The ON signal of the limit switch LS-4 stops the cam shaft 4, whereby the cam shaft 4 finishes one rotation of 360°.

Figure 4:
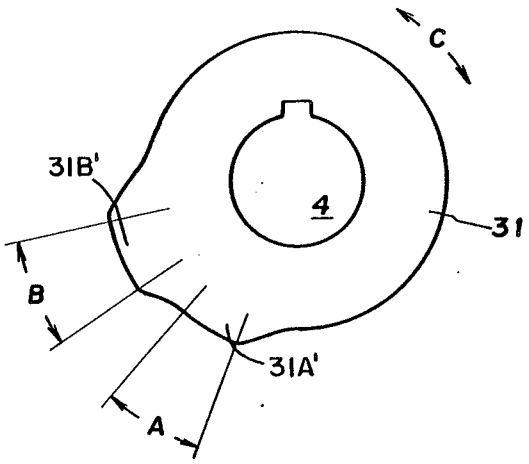

FIG. 4 illustrates a tension cam different from that in the above embodiment. Two projections 31A', 31B' having acting surfaces A, B are formed on the outer periphery of the tension cam 31'. The first acting surface A is on a shorter radius than the second acting surface B which is situated ahead of the surface A in the rotational direction. The acting surface A is an acting surface for displacing the reverse touch roller 23 toward the reverse roller 20 sufficiently for removing the band from the arch guide and winding it around an article to be strapped. The acting surface B is an acting surface for strongly tightening the band wound around the article to be strapped. In the drawing, C is a non-acting surface of the arm rod 46 of the tension cam 31.

Figure 5:
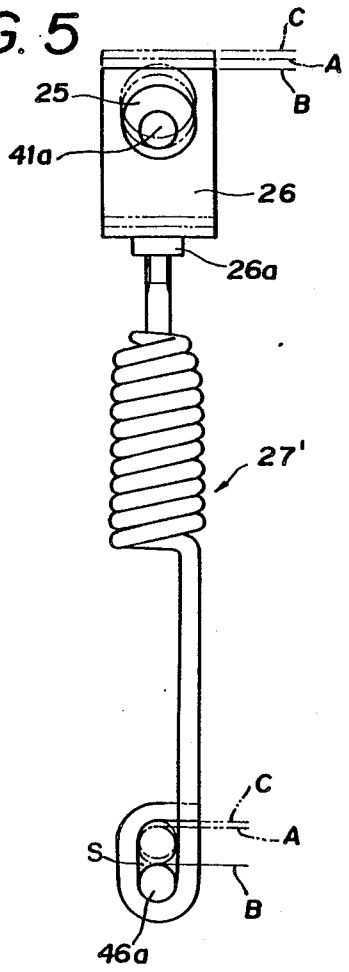
FIG. 5 is a schematic diagram showing the relationship between the acting surface of the tension cam and the action of the reverse rotation spring and a shaft rod.

FIG. 5 illustrates a spring 27' for use with the cam 31A. The lower end of the reverse rotation spring 27 is folded to form a slot S and the projection **46*a* of the arm 46** is inserted into the slot S.

It will be understood that the surface A pulls the shaft case 15 downwardly by a shorter distance than the surface B. The surface A pulls the shaft case down during a band-restoring and preliminary band-tightening step, whereas surface B applies further downward force to the shaft case by stretching the spring 27' for a subsequent band-tightening step.

No stretching of the reverse rotation spring 27' is needed during the band-restoring process for winding the band around the article to be strapped by means of the acting surface A of the tension cam 31 which acts for the established time of the timer when the limit switch LS-2 is turned ON. The band is restored at a low torque and high speed and unnecessary compressive contact force is not applied to the band surface by means of the reverse rotation touch roller, whereby abrasion and cutting of the band are avoided.

Accordingly, when the band is restored to wind around the article to be strapped, the peripheries of the reverse rotation roller 20 and the reverse rotation touch roller 23 are brought into contact with both surfaces of the band by means of a gap between the peripheries thereof, the thickness of the gap being equal to or less than the thickness of the band, thereby restoring the band. The respective members are placed at positions A in the drawing during such restoration.

Vertical displacement of the shaft rod 25 places the projection 46*a* of the arm rod 46 at different positions, and thus performs a vertical adjustment of the elevations A and B. The arm 46 is lowered by the actuating surface A to turn ON the limit switch LS-2 and a signal is generated thereby to stop the cam shaft 4 for the established time of the timer. Accordingly, the band is restored from the time when the limit switch LS-2 is turned on to the finish of the established time of the timer whereby the band is wound around the article to be strapped.

When the second actuating surface B of the tension cam 31 pushes down the arm 46 through the intermediary of the rotor 45 by means of the cam shaft 4 which re-rotates after passage of the established time of the timer, the spring 27' is stretched, whereby the reverse rotation touch roller 23 is positively brought into greater compressive contact with the band, thereby further tightening the band (i.e., the subsequent tightening process). The established time of the timer is dependent upon the total length of the arch guide or the dimension of the article to be strapped.

The amount of stretching of the spring 27 in the subsequent tightening process is determined according to variation in the distance between the projected shaft 41*a* (adjusted by the rotation of the shaft rod 25) and the front end of the arm 46, whereby the compressive contact force against the band is properly adjusted. The respective members are situated at positions B in the drawing during the subsequent tightening step.

Tightening by means of the rollers 20 and 23 is finished when the rotor 45 engages surface C.

The lock nut 26*a* and the other members are adjusted for additional gaps of 0.3 mm or more between both rollers even when the maximum tightening force is obtained, such that the apparatus is so designed to prevent unnecessary force applied thereto.

The reverse rotation roller 20 is gear driven when the band is tightened, so that the band is tightened against the article to be strapped with large torque. The respective press members and the heater (not shown) which ascend, descend, and travel by means of the cam shaft 4 which continues rotation thereafter as is the case with the above-described embodiment, perform fusion of the band-joining portions and cutting of the band-feeding end, whereby the solenoid 43 is actuated to feed the band into the outside of the main body.

When the reverse rotation roller 20 is coupled with the reverse rotation touch roller 23 by means of gears and when the tension cam 31 is situated on the actuating surface A or the non-actuating surface C, both gears rotate in loose engagement with each other but the spring 27 itself is not stretched to any appreciable extent, and hence exerts no spring-biasing effect on the band. When the surface B pushes the arm 46 down further, the spring becomes appreciably stretched.

What is claimed is:

1. In a strapping machine for applying a band around an article, said machine comprising a forward-rotation drive roller and an opposing forward-rotation touch roller defining therebetween a band-feeding nip, a reverse-rotation drive roller and an opposing reverse-rotation touch roller defining therebetween a band-retracting nip for tightening a previously-fed band around the article, band-handling means for gripping, fusing, and cutting a band which has been tightened around an article, an eccentric shaft upon which said reverse-rotation touch roller is mounted, a shaft case connected to said eccentric shaft, an arm mounted for displacement, spring means connecting said arm to said shaft case, and a rotary cam shaft carrying a cam arranged to contact and displace said arm in a direction producing displacement of said shaft case and concurrent rotation of said eccentric shaft for moving said reverse-rotation touch roller toward said reverse-rotation drive roller, the improvement comprising an eccentric shaft rod rotatably mounted on said eccentric shaft and rotatably connected to said shaft case such that rotation of said eccentric shaft rod relative to said shaft case varies the magnitude of force applied to said reverse-rotation roller in response to displacement of said arm by said cam, and manually actuable means operably connected to said eccentric shaft rod for rotating the latter.

2. A strapping machine according to claim 1, wherein said manually actuable means comprises a knob connected to said shaft rod by a flexible member.

3. A strapping machine according to claim 1, wherein said eccentric shaft includes a projected shaft extending into an eccentric hole of said shaft rod, said shaft rod arranged to vary the distance between said projected shaft and an end of said spring means attached to said arm, in response to rotation of said shaft rod.

4. A strapping machine according to claim 1, wherein said cam has a single cam projection for displacing said arm.

5. A strapping machine according to claim 1, wherein said cam includes two circumferentially successive cam projections extending at different radii from an axis of rotation of said cam shaft for pressuring said reverse-rotation touch roller against the band with different forces.

6. A strapping machine according to claim 5, wherein said spring means includes a coil spring, an end of said coil spring which is connected to said arm defining a slot in which a projection of said arm is disposed with play.

7. A strapping machine according to claim 6, wherein an amount of said play corresponds to an amount of adjustment afforded by rotation of said shaft rod.

8. A strapping machine according to claim 6 including switch means actuable for terminating rotation of said cam shaft for a pre-established period, said arm arranged to actuate said switch means when displaced by the one of said projections having a shorter radius.

9. A strapping machine according to claim 1, wherein said spring means is a coil spring, one end of said arm being pivotably mounted and its other end being connected to a lower end of said coil spring, said cam engaging said arm intermediate said ends of said arm.

10. A strapping machine according to claim 1, wherein said forward-rotation touch roller is mounted on an additional eccentric shaft, a first additional spring means operably connected to and biasing said additional eccentric shaft in a direction away from said forward-rotation drive roller, a second additional spring means operably connected at one end to said additional eccentric shaft, and an electric solenoid operably connected to another end of said second additional spring means for displacing the latter in a direction for moving said forward-rotation touch roller toward said forward-rotation drive roller.

11. A strapping machine according to claim 1, wherein said forward-rotation drive roller and spring reverse-rotation drive roller are connected to a common drive gear.

12. A strapping machine according to claim 1 including switch means actuable for terminating rotation of said cam shaft for a pre-established period, said arm arranged to actuate said switch means when displaced by said cam.

13. In a strapping machine for applying a band around an article, said machine comprising a forward-rotation drive roller and an opposing forward-rotation touch roller defining therebetween a band-feeding nip, a reverse-rotation drive roller and an opposing reverse-rotation touch roller defining therebetween a band-retracting nip for tightening a previously-fed band around the article, band-handling means for gripping, fusing, and cutting a band which has been tightened around an article, an eccentric shaft upon which said reverse-rotation touch roller is mounted, a shaft case connected to said eccentric shaft, an arm mounted for displacement, spring means connecting said arm to said shaft case, and a rotary cam shaft carrying a cam arranged to contact and displace said arm in a direction producing displacement of said shaft case and concurrent rotation of said eccentric shaft for moving said reverse-rotation touch roller toward said reverse-rotation drive roller, the improvement wherein said cam comprises first and second circumferentially successive projections protruding at different radial distances from an axis of rotation of said cam, said first projection being shorter than said second projection and dimensioned to displace said arm and said shaft case sufficiently to bring said reverse-rotation touch roller into contact with the previously-fed band for restoring the band around the article, said second projection dimensioned to displace said arm to energize said spring means for intensifying the force with which said reverse-rotation touch roller engages the band for further tightening the band around the article.

* * * * *